US011270829B2

(12) United States Patent
Lee et al.

(10) Patent No.: US 11,270,829 B2
(45) Date of Patent: Mar. 8, 2022

(54) COIL COMPONENT

(71) Applicant: SAMSUNG ELECTRO-MECHANICS CO., LTD., Suwon-si (KR)

(72) Inventors: Yong Sam Lee, Suwon-si (KR); Eo Jin Choi, Suwon-si (KR); Jae Hun Kim, Suwon-si (KR); Ji Hyun Eom, Suwon-si (KR); Hye Yeon Cha, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/664,062

(22) Filed: Oct. 25, 2019

(65) Prior Publication Data

US 2020/0058431 A1 Feb. 20, 2020

Related U.S. Application Data

(63) Continuation of application No. 15/676,446, filed on Aug. 14, 2017, now Pat. No. 10,504,644.

(30) Foreign Application Priority Data

Oct. 28, 2016 (KR) ..... 10-2016-0142182
Nov. 15, 2016 (KR) ..... 10-2016-0152020

(51) Int. Cl.
*H01F 27/32* (2006.01)
*H01F 27/02* (2006.01)
(Continued)

(52) U.S. Cl.
CPC ..... *H01F 27/02* (2013.01); *H01F 17/0013* (2013.01); *H01F 27/24* (2013.01);
(Continued)

(58) Field of Classification Search
CPC .... H01F 27/02; H01F 27/292; H01F 17/0013; H01F 27/24; H01F 27/29;
(Continued)

(56) References Cited

U.S. PATENT DOCUMENTS 6,181,232 B1 1/2001 Kitamura
6,466,401 B1 * 10/2002 Hong ..... G11B 5/313 360/123.25
(Continued)

FOREIGN PATENT DOCUMENTS

CN 1207565 A 2/1999
CN 101356599 A 1/2009
(Continued)

OTHER PUBLICATIONS

First Office Action issued in Chinese Patent Application No. 201710946709.4 dated May 28, 2019, with English translation.
(Continued)

*Primary Examiner* — Mang Tin Bik Lian
(74) *Attorney, Agent, or Firm* — Morgan, Lewis & Bockius LLP

(57) ABSTRACT

A coil component includes a body, including a coil and a support member supporting the coil, and an external electrode disposed on an external surface of the body. The coil component includes a machined surface formed on a boundary surface between a portion of the support member, removed in the vicinity of a junction portion between the external electrode and the coil, and the remainder of the support member. A cavity, from which the portion of the support member has been removed, is filled with a magnetic material, or an insulating layer is disposed in the cavity.

20 Claims, 5 Drawing Sheets

(51) Int. Cl.

| | |
|---|---|
| ***H01F 27/29*** | (2006.01) |
| ***H01F 17/00*** | (2006.01) |
| ***H01F 27/24*** | (2006.01) |
| *H01F 17/04* | (2006.01) |

(52) U.S. Cl.
CPC ..... *H01F 27/29* (2013.01); *H01F 27/292* (2013.01); *H01F 27/32* (2013.01); *H01F 27/323* (2013.01); *H01F 2017/048* (2013.01)

(58) Field of Classification Search
CPC ..... H01F 2017/048; H01F 17/045; H01F 27/306; H01F 2027/2809; H01F 27/32; H01F 27/323; H01F 27/324
See application file for complete search history.

(56) References Cited

U.S. PATENT DOCUMENTS

| | | | | |
|---|---|---|---|---|
| 2003/0151849 | A1 | 8/2003 | Sasaki et al. | |
| 2007/0030659 | A1 | 2/2007 | Suzuki et al. | |
| 2007/0222550 | A1* | 9/2007 | Fujiwara | H01F 17/0033 336/200 |
| 2008/0218301 | A1* | 9/2008 | Yamaguchi | H01F 17/0013 336/83 |
| 2009/0021212 | A1 | 1/2009 | Hasegawa et al. | |
| 2009/0051474 | A1 | 2/2009 | Lee et al. | |
| 2009/0128275 | A1 | 5/2009 | Yagasaki et al. | |
| 2012/0274433 | A1 | 11/2012 | Matsumoto et al. | |
| 2013/0222101 | A1* | 8/2013 | Ito | H01F 5/003 336/83 |
| 2013/0300529 | A1* | 11/2013 | Chang | H01F 27/292 336/173 |
| 2013/0341758 | A1 | 12/2013 | Lee et al. | |
| 2014/0009254 | A1* | 1/2014 | Ohkubo | H01F 27/29 336/192 |
| 2014/0022041 | A1* | 1/2014 | Park | H01F 5/00 336/199 |
| 2014/0167897 | A1* | 6/2014 | Choi | H01F 41/0246 336/83 |
| 2014/0184374 | A1* | 7/2014 | Park | H01F 17/0013 336/83 |
| 2015/0035634 | A1* | 2/2015 | Nakamura | H01F 41/046 336/170 |
| 2015/0035640 | A1* | 2/2015 | Wang | H01F 27/2804 336/200 |
| 2015/0187484 | A1 | 7/2015 | Jeong et al. | |

FOREIGN PATENT DOCUMENTS

| | | | |
|---|---|---|---|
| CN | 101404203 | A | 4/2009 |
| CN | 202585541 | U | 12/2012 |
| CN | 103377811 | A | 10/2013 |
| EP | 0 896 345 | A2 | 2/1999 |
| JP | H11-054326 | A | 2/1999 |
| JP | 2005-210010 | A | 8/2005 |
| JP | 2007-067214 | A | 3/2007 |
| JP | 2012-234868 | A | 11/2012 |
| JP | 5084459 | B2 | 11/2012 |
| JP | 2015-216336 | A | 12/2015 |
| KR | 10-2009-0019251 | A | 2/2009 |
| KR | 10-2013-0049207 | A1 | 5/2013 |
| KR | 10-2015-0080716 | A | 7/2015 |
| KR | 10-2015-0080717 | | 7/2015 |
| KR | 10-1580709 | B1 | 12/2015 |
| WO | 2008/018203 | A1 | 2/2008 |

OTHER PUBLICATIONS

Notice of Office Action issued in Korean Patent Application No. 10-2016-0152020 dated Jan. 12, 2018, with English abstract.
Notice of Office Action for Japanese Patent Application No. 2017-152539 dated Apr. 24, 2018, with English translation.
Notice of Office Action issued in Korean Patent Application No. 10-2016-0152020 dated Jun. 25, 2018, with English translation.
Notice of Allowance issued in U.S. Appl. No. 15/676,446 dated Aug. 8, 2019.
Final Office Action issued in U.S. Appl. No. 15/676,446 dated Jun. 6, 2019.
Non-Final Office Action issued in U.S. Appl. No. 15/676,446 dated Feb. 21, 2019.
Office Action issued in corresponding Japanese Patent Application No. 2018-138909 dated Aug. 3, 2021, with English translation.
Office Action issued in corresponding Chinese Patent Application No. 202011117905.9 dated Nov. 3, 2021, with English translation.

* cited by examiner

COIL COMPONENT

CROSS-REFERENCE TO RELATED APPLICATION

This application is the continuation application of U.S. patent application Ser. No. 15/676,446 filed on Aug. 14, 2017, which claims the benefit of priority to Korean Patent Applications No. 10-2016-0142182 filed on Oct. 28, 2016 and No. 10-2016-0152020 filed on Nov. 15, 2016, with the Korean Intellectual Property Office, the disclosures of which are incorporated herein by reference in their entireties.

BACKGROUND

1. Field

The present disclosure relates to a coil component and, more particularly, to a thin film power inductor.

2. Description of Related Art

Recently, with a continued trend in the miniaturization and thinning of smartphones and wearable devices, chip size in power inductors has been reduced, and composite materials using magnetic metallic materials have been used in power inductors to achieve high efficiency.

Efforts have been undertaken on miniaturized power inductors to provide characteristics, such as high capacity and low direct current resistance (RDC), due to the limitations of chip size. For example, the content of a magnetic material is increased for the same chip size by changing a C-shaped external electrode extending to an upper surface of a conventional chip to an L-shaped external electrode not extending to the upper surface of the conventional chip. However, notwithstanding this effort, the problems caused by delamination, due to difficulties in securing adhesion between heterogeneous materials or by an increase in the content of magnetic materials, have not been solved.

SUMMARY

An aspect of the present disclosure may provide a coil component that may increase a level of inductance by increasing a space which may be filled with a magnetic material, while having a reduced chip size.

According to an aspect of the present disclosure, a coil component may include a body including a coil and a magnetic material, and an external electrode disposed on at least a portion of an external surface of the body and having an internal surface contacting and electrically connected to the coil. The coil includes at least one lead portion. A support member may be disposed in the body to support the coil, and at least a portion of a surface of the support member facing toward the internal surface of the external electrode may include a machined surface.

According to another aspect of the present disclosure, a coil component may include a body including a coil, the coil including a coil body and at least one lead portion connected to the coil body. The coil component further includes an external electrode disposed on at least a portion of an external surface of the body and electrically connected to the at least one lead portion of the coil. The body may further include a support member, the coil is disposed on one surface of the support member, and an outer boundary surface of the support member may be spaced apart from a junction portion between the external electrode and the at least one lead portion at a predetermined interval.

According to a further aspect of the present disclosure, a coil component includes a support member having a surface with a coil disposed thereon, a body formed of a magnetic material, and an external electrode disposed on an external surface of the body and contacting a lead portion of the coil. The support member and coil are disposed within the body. A thickness of the support member, measured orthogonally to the surface of the support member having the coil disposed thereon, is smaller at a position closer to the external electrode than at a position further from the external electrode.

According to a further aspect of the present disclosure, a coil component includes a support member having a coil disposed thereon, a body formed of a magnetic material, and an external electrode disposed on an external surface of the body and contacting a lead portion of the coil. The support member and coil are disposed within the body. A surface of the support member facing the external surface of the body having the external electrode includes at least two protrusions separate from each other and extending towards the external surface of the body.

According to another aspect of the present disclosure, a coil component includes a support member having a coil disposed thereon, a body formed of a magnetic material, and an external electrode disposed on an external surface of the body and contacting a lead portion of the coil. The support member and coil are disposed within the body. Additionally, a surface of the support member facing the external surface of the body having the external electrode is coplanar with an outermost coil pattern of the coil body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
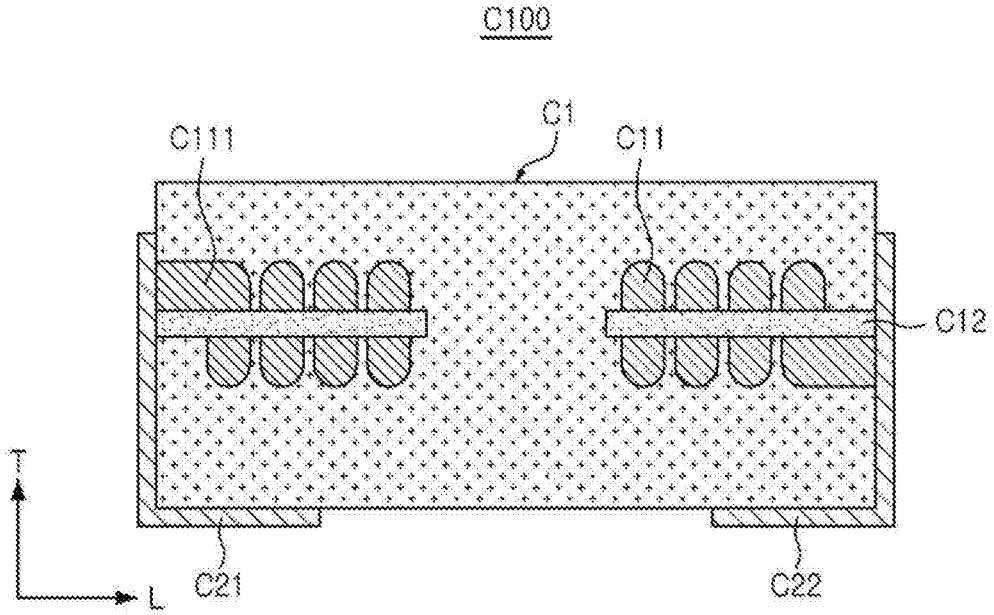
PRIOR ART FIG. 1
FIG. 1 is a schematic cross-sectional view of an example of a thin film inductor according to the related art.

Hereinafter, embodiments of the present disclosure will be described with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region, or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that, although the terms 'first,' 'second,' 'third,' etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the exemplary embodiments.

Spatially relative terms, such as "above," "upper," "below," and "lower" and the like, may be used herein for ease of description to describe one element's positional relationship relative to other element(s) in the illustrative orientation shown in the figures. However, it will be understood that spatially relative terms are intended to encompass different orientations of the device in use or operation, in addition to the orientation depicted in the figures. For example, if the device in the figures is turned over, elements described as "above" or "upper" relative to other elements would then be oriented "below" or "lower" relative to the other elements or features. Thus, the term "above" can encompass both the above and below orientations, depending on a particular directional orientation of the figures. The device may also be oriented otherwise (e.g., rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views shown in the drawings and illustrating embodiments of the present disclosure. In the drawings, components having ideal shapes are shown. However, variations from these ideal shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted alone or as a combination of several or all thereof.

The contents of the present disclosure described below may have a variety of configurations, and only an illustrative configuration is proposed herein, but the present disclosure is not limited thereto.

Hereinafter, a coil component according to an embodiment will be described, but the present disclosure is not limited thereto.

FIG. 1 is a schematic cross-sectional view of a coil component C100 according to the related art. The coil component C100 of FIG. 1 may include a body C1, including a coil C11 and a support member C12 supporting the coil C11, and a first external electrode C21 and a second external electrode C22 disposed on an external surface of the body C1.

As illustrated in FIG. 1, a coil lead portion C111 corresponding to a connecting portion, connecting the coil C11 to the first and second external electrodes C21 and C22, may be supported by the support member C12, and the support member C12 may be disposed on the entirety of a lower surface of the coil lead portion C111. As a result, an end portion of a side surface of the support member C12 may be in contact with the first and second external electrodes C21 and C22.

When the end portion of the side surface of the support member C12 supporting the coil C11 is in contact with the first and second external electrodes C21 and C22, adhesion between an electrode paste used in forming the first and second external electrodes C21 and C22 and the support member C12 may be poor. Thus, when the first and second external electrodes C21 and C22 are plated, delamination thereof may occur frequently. Further, considering a common manufacturing process of a coil component, a support member and a coil pattern may be embedded in a magnetic material, and then the magnetic material may be diced to expose a lead portion of the coil pattern. When a dicing blade is in contact with the support member, a difficult-to-machine material included in the support member, for example, a glass frit or the like, may quicken abrasion of the dicing blade.

A coil component 100 according to an embodiment may be designed to solve the above issues and may provide various effects in addition to solving the above-mentioned issues.

Figure 2:
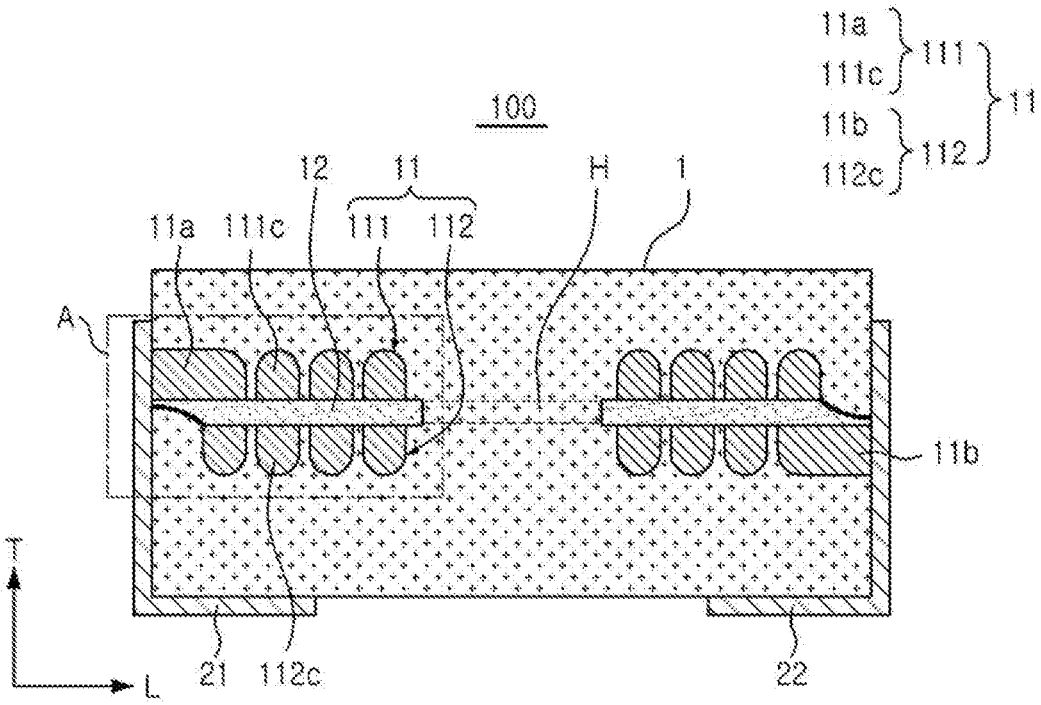
FIG. 2 is a schematic cross-sectional view of a coil component according to an embodiment.

FIG. 2 is a schematic cross-sectional view of the coil component 100 according to an embodiment.

Referring to FIG. 2, the coil component 100 may include a body 1, and a first external electrode 21 and a second external electrode 22 disposed on at least a portion of an external surface of the body 1.

The body 1 may form the overall exterior of the coil component 100, may have an upper surface and a lower surface opposing each other in a thickness direction T, a first side surface and a second side surface opposing each other in a length direction L, and a first cross section and a second cross section opposing each other in a width direction W, and may have a substantially hexahedral shape. However, the present disclosure is not limited thereto.

The body 1 may include a magnetic material having magnetic characteristics. For example, the magnetic material may be formed by incorporating ferrite or magnetic metallic particles in a resin. The magnetic metallic particles may include at least one selected from the group consisting of iron (Fe), silicon (Si), chromium (Cr), aluminum (Al), and nickel (Ni).

The first and second external electrodes 21 and 22, disposed on the at least a portion of the external surface of the body 1, may be illustrated in FIG. 2 as having an "L"

shape each extending onto two adjacent external surfaces of the body 1. However, detailed shapes of the first and second external electrodes 21 and 22 are not limited. For example, the first and second external electrodes 21 and 22 may have a "C" shape extending to the upper surface of the body 1, as well as the lower surface and the first and second side surfaces of the body 1 (e.g., extending onto three external surfaces of the body 1). Alternatively, the first and second external electrodes 21 and 22 may be formed of a lower electrode disposed on only the lower surface of the body 1, but shapes and materials of the first and second external electrodes 21 and 22 are not limited thereto.

The first and second external electrodes 21 and 22 may be electrically connected to a coil 11 included in the body 1, and thus may include, for example, a material having excellent electrical conductivity. The first and second external electrodes 21 and 22 may be formed of, for example, nickel (Ni), copper (Cu), silver (Ag), or alloys thereof, and may also include multiple layers (e.g., multilayers). In some cases, each of the first and second external electrodes 21 and 22 may be formed by forming a wiring plated with copper (Cu) in an innermost portion thereof and then disposing a plurality of plating layers on the formed wiring. However, materials and formation methods of the first and second external electrodes 21 and 22 are not limited thereto.

When viewed from the inside of the body 1, the body 1 may include the coil 11 buried by the magnetic material and a support member 12 supporting the coil 11. The coil 11 may include an upper coil 111 disposed on the upper surface of the support member 12 and a lower coil 112 disposed on the lower surface of the support member 12. The upper and lower coils 111 and 112 may be electrically connected to each other through a via (not illustrated) extending through the support member 12. However, the present disclosure is not limited thereto. For example, a plurality of upper coils may also be disposed on only the upper surface of the support member 12 or, alternatively, it may be sufficient to include at least one coil supported by the support member 12.

The coil 11 may have an overall spiral shape, but the present disclosure is not limited thereto. Further, the coil 11 may include a metallic material having excellent electrical conductivity, for example, copper (Cu).

The coil 11 may include a first lead portion 11*a* connected to the first external electrode 21 and a second lead portion 11*b* connected to the second external electrode 22. A coil region of the upper coil 111 of the coil 11, excluding the first lead portion 11*a*, may be a coil body 111*c*, and a coil region of the lower coil 112 of the coil 11, excluding the second lead portion 11*b*, may be a coil body 112*c*.

The support member 12 supporting the coil 11 will be described below.

The support member 12 may be provided to form the coil 11, having a further reduced thickness, and to form the coil 11 more easily, and may be an insulating substrate formed of an insulating resin. The insulating resin may include a thermosetting resin such as an epoxy resin, a thermoplastic resin such as a polyimid, or a resin in which a stiffener such as a glass fiber or an inorganic filler is impregnated such as a pre-preg, an Ajinomoto build-up film (ABF), a FR-4 resin, a bismaleimide triazine (BT) resin, or a photoimageable dielectric (PID) resin. When the support member 12 includes glass fiber, stiffness of the support member 12 may be increased.

The support member 12 may have a through hole H formed in a central portion thereof (e.g., a central portion in which the coil 11 is not disposed). The through hole H may be filled with the magnetic material (e.g., the same magnetic material used to form the body 1) to form a core portion of a magnetic core, and may increase permeability of the coil component 100.

Figure 3:
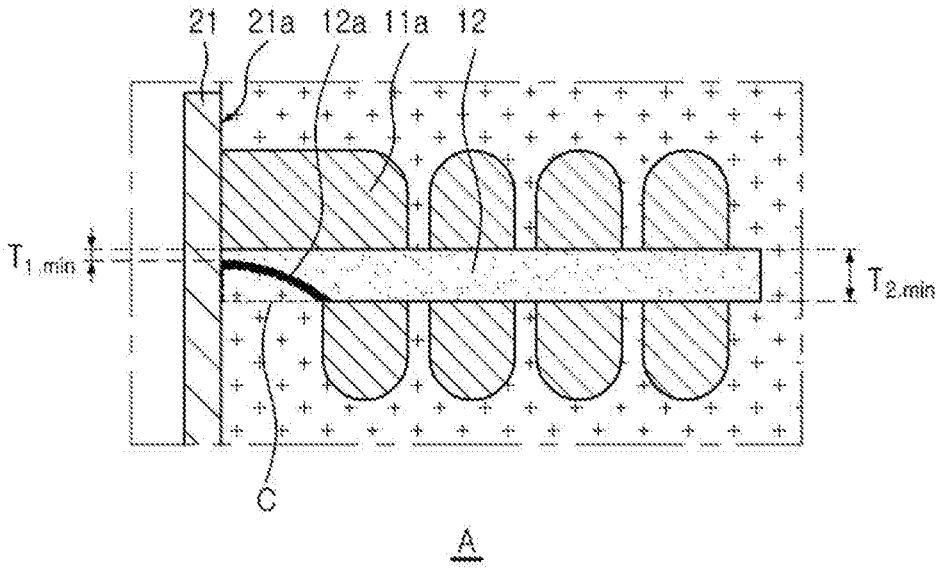
FIG. 3 is an enlarged view of region A of FIG. 2.

Referring to FIG. 3, which depicts an enlarged view of region A of FIG. 2, a structure of the support member 12 will be described in more detail. Region A of FIG. 2 includes a region of the first external electrode 21 for illustrative purposes. However, as shown, FIG. 2 also includes the second external electrode 22, and thus descriptions of FIG. 3 may also be applied to another region of FIG. 2 disposed opposite to region A in the length direction L and including the second external electrode 22. Further, descriptions of items mentioned in relation to FIG. 2 that are present in FIG. 3 will be omitted to avoid repeated descriptions.

With regard to a thickness of the support member 12, a minimum thickness (T1.min) of the portion of the support member 12 disposed below at least a region of a lower surface of the first lead portion 11*a* of the coil 11, may be less than a minimum thickness (T2.min) of the portion of the support member 12 disposed below at least a region of a lower surface of an innermost coil pattern of the coil 11. This means that, in some examples, a part of the support member 12, disposed below the at least a region of the lower surface of the first lead portion 11*a* of the coil 11, has been removed.

Referring to FIG. 3, the support member 12 may include an outer surface contacting the first external electrode 21, and at least a portion of the outer surface may include a machined surface 12*a*. Here, the inclusion of the machined surface 12*a* means that the support member 12 includes a surface which has been subjected to a predetermined after-treatment, on the outer surface thereof. In detail, as long as the after-treatment includes processes that may remove a portion of an initial support member, the after-treatment may be applied without limitation. A boundary surface between a portion of the support member 12, left without being removed, and a removed portion of the support member 12, removed by the after-treatment, may be formed as the machined surface 12*a*. For example, the after-treatment may be applied with a laser trimming technology using a $CO_2$ laser beam, and the laser trimming technology for forming the machined surface 12*a* may be applied without adding a processing operation. This is because when a common thin power inductor is manufactured, forming a coil on a support member by plating the support member, and laser trimming processing using the $CO_2$ laser beam for removing an outer portion or a central portion of the support member in which the coil is not formed, may be required. Removing a portion of the support member after the forming of the coil may allow magnetic flux generated from the coil to flow readily in a magnetic material without obstacles such as a substrate or the like, thus preventing a level of inductance from being reduced. After the formation of the coil, the laser trimming processing operation may be used to remove the support member having no coil formed thereon, a portion of (e.g., by thinning) the support member having the coil formed thereon, as well as the support member having no coil formed thereon, to thus increase process efficiency.

Referring to FIG. 3, the machined surface 12*a* of the outer surface of the support member 12 contacting an internal surface 21*a* of the first external electrode 21 may be formed as a curve. The curve may form a smooth surface, and may have a predetermined surface roughness ($R_a$) and repeated troughs and crests. The structure of the curve is not limited thereto. The machined surface 12*a* may be a surface on which the after-treatment using the laser trimming processing operation has been completed. The machined surface 12*a* may have a shape such that the support member 12 has a thickness reduced toward a side portion thereof adjacent to the first external electrode 21.

In the coil component 100 according to an embodiment, the support member 12 may include the machined surface 12*a* in a side portion thereof contacting the first external electrode 21. As such, an area in which the internal surface 21*a* of the first external electrode 21 and the support member 12 are in contact with each other may be significantly reduced.

Generally, the support member 12 may be formed of a material having insulating characteristics. As a result, the support member 12 may have poor affinity with a conductive material of the first external electrode 21. As a result, when the support member 12 is bonded to the first external electrode 21, a delamination phenomenon may occur frequently, in which the first external electrode 21 may be separated from the support member 12 in a bonding region therebetween. As in the coil component 100, because the support member 12 has a thinned profile at a side surface contacting the first external electrode 21, the area of the junction portion having poor affinity may be reduced to avoid the delamination phenomenon, thus increasing structural reliability.

As illustrated in FIG. 2, an L-shaped external electrode is employed instead of a C-shaped external electrode, such as may be used in the related art, to reduce a volume occupied by the external electrode in a chip, thus increasing permeability. In such a situation, the external electrode may frequently not be fixed stably in the chip. However, the coil component 100 may reduce the area of the junction portion between the first or second external electrode 21 or 22 and the support member 12, and thereby reduce a cause of the delamination phenomenon. Thus, when a structure of a modified external electrode is applied to the coil component 100, structural reliability thereof may be increased.

Further, just as a material such as a glass fabric or the like may often be included in the support member 12, the support member 12 may include a difficult-to-machine material. However, in the coil component 100 according to this embodiment, the outer surface of the support member 12 exposed to an outer portion of the body 1, along with the first lead portion 11*a* of the coil 11, may have a relatively small area. As a result, when the coil component 100 is diced into individual chips, a contact area between a dicing blade and the support member 12 may be significantly reduced. As such, a possibility that the dicing blade is in contact with the difficult-to-machine material may be significantly reduced; thus, a rate at which the dicing blade wears may be significantly decreased.

Region C, indicated by the dashed line in FIG. 3, identifies a cavity previously occupied by the portion of the support member 12 that is removed from the initial support member. The cavity may be used as a margin portion that may be filled with the magnetic material (e.g., the magnetic material forming the body 1). In some cases, the cavity may also be used as a margin portion of the coil design.

Subsequently, modifications of a detailed shape of the machined surface 12*a* of the support member 12 of FIG. 3 will be described with reference to FIGS. 4A through 4C. However, the detailed shape of the machined surface 12*a* included in the coil component 100 according to this embodiment is not limited only to the embodiments described below.

Figure 4A:
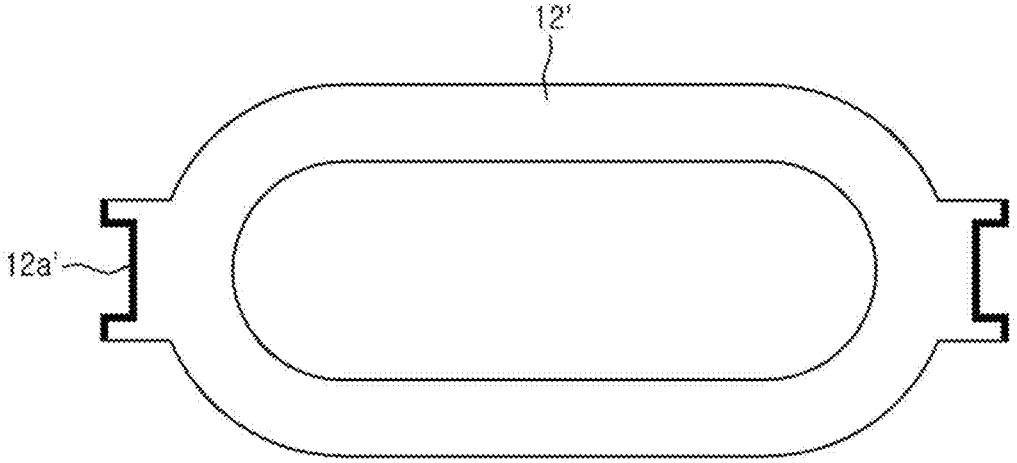
FIGS. 4A through 4C are enlarged views of various modifications of FIG. 3.
Figure 4B:
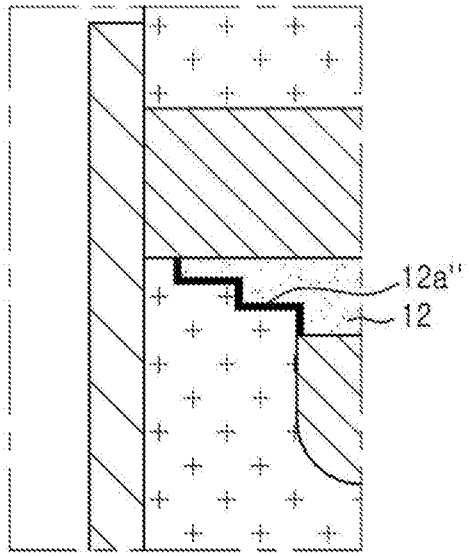

Referring to FIG. 4A, a machined surface 12*a*' of a support member 12' may have a concave slit shape. For convenience of explanation, FIG. 4A is a schematic top view viewed from an upper surface of a body, and schematically illustrates only an exterior of the support member 12'.

The concave slit shape may have a substantially overall "U" shape, as illustrated in FIG. 4A, and may be formed by selectively removing only a central portion of the support member 12' toward an inside of the support member 12' from a bonding surface of the support member 12' contacting an internal surface of an external electrode. Even when the machined surface 12*a*' of the support member 12' has the concave slit shape, as illustrated in FIG. 4A, a margin portion, that may be filled with a magnetic material or the like, may be secured, and a bonding area between the external electrode and the support member 12' may be reduced in the same manner as above. Thus, the machined surface 12*a*' of the support member 12' may be used as a modification of the above embodiments. As shown in FIG. 4A, the concave slit shape results in two protrusions being disposed in a surface of the support member 12' facing the external surface of the body 1 having an external electrode thereon. The protrusions are separate from each other and extend towards the external surface of the body having the external electrode thereon. A central portion of the surface of the support member facing the external surface of the body, the central portion being disposed between the at least two protrusions, is spaced further away from the external surface of the body than the at least two protrusions. In some examples, the two protrusions extend to and contact the external surface of the body and the external electrode; in other examples, the two protrusions are spaced apart from and do not contact the external surface of the body and the external electrode.

Subsequently, referring to FIG. 4B, a machined surface 12*a*" of a support member 12 may have a staircase shape having a thickness reduced stepwise toward a side portion thereof facing the external electrode (e.g., 21). For example, adhesion between the support member 12 and an external electrode, or abrasion of a dicing blade, may be reduced by varying an intensity of the $CO_2$ laser beam and removing a relatively large amount of an outer portion of the support member 12, for example, a portion of the support member 12 disposed to be adjacent to the external electrode.

Figure 4C:
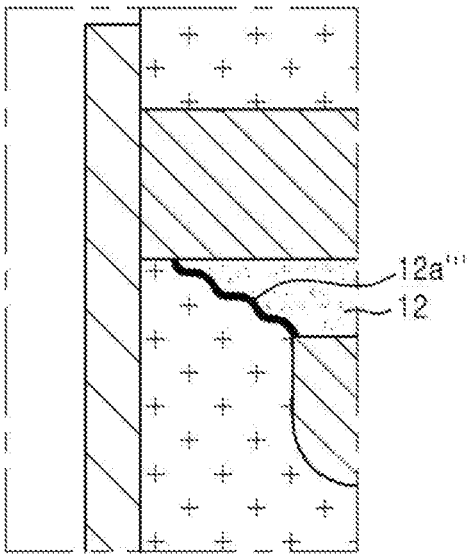

FIG. 4C illustrates a machined surface 12*a*'" of support member 12 having a predetermined surface roughness ($R_a$) and a wave shape of repeated troughs and crests, as briefly mentioned earlier in this application in the description of the machined surface 12*a* of the curve of FIG. 3. As will be described later, when an insulating layer is coated on the machined surface 12*a*'" of the support member 12, adhesion of the insulating layer may be increased due to the surface roughness ($R_a$).

Figure 5:
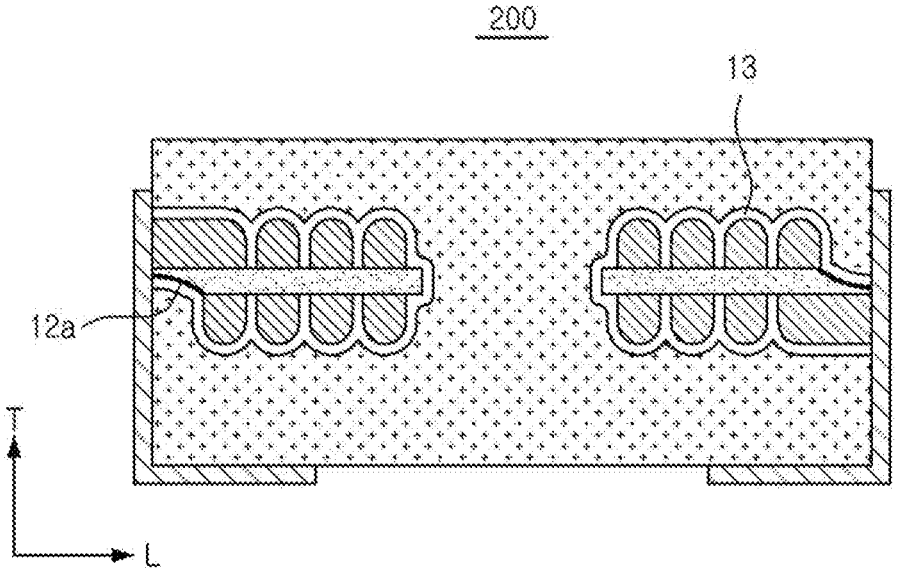
FIG. 5 is a schematic cross-sectional view of a modification of FIG. 2.

FIG. 5 is a schematic cross-sectional view of a coil component 200 according to a modification of the coil component 100 of FIG. 2. As illustrated in FIGS. 2 and 5, similar components in both figures are denoted by the same reference numerals of FIG. 2.

The coil component 200 of FIG. 5 may differ from the coil component 100 of FIG. 2 in that an insulating layer 13 may be additionally disposed on an external surface of a coil and on an exposed surface of a support member.

Referring to FIG. 5, the insulating layer 13 may be disposed on a machined surface 12*a* of the support member. The insulating layer 13 may be coated on the machined surface 12*a* of the support member simultaneously with the application thereof to the external surface of the coil. Thus, the insulating layer 13 may be formed consecutively over the coil and the exposed surface of the support member. In a common coil component according to the related art, for example, referring to FIG. 1, there is no room to form an insulating layer because entireties of side surfaces of a substrate, excluding an upper surface or a lower surface thereof, are removed by a dicing blade. However, the coil component 200 according to an embodiment may include the machined surface 12*a*, formed by removing a portion of the support member, and thus it is not limited to forming the insulating layer 13 on the machined surface 12*a*.

Figure 6:
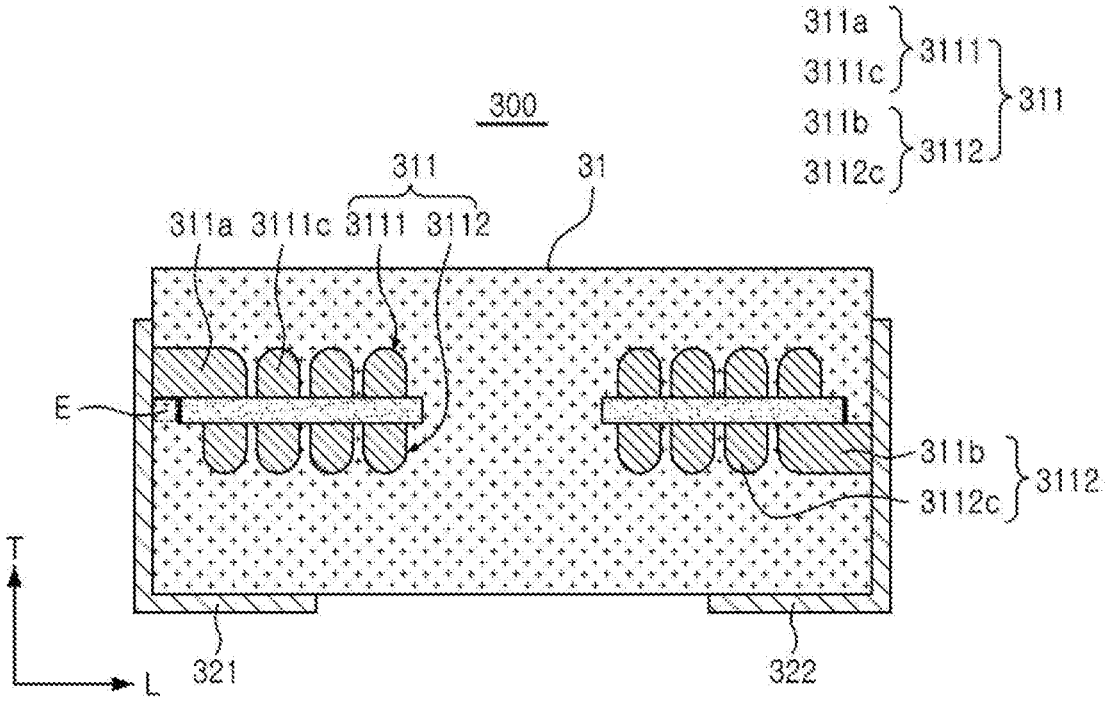
FIG. 6 is a schematic cross-sectional view of a coil component according to another embodiment.

FIG. 6 is a schematic cross-sectional view of a coil component 300 according to another embodiment. In descriptions of the coil component 300 of FIG. 6, descriptions overlapping those of the coil component 100 of FIG. 2 or the coil component 200 of FIG. 5, described above, will be omitted.

Referring to FIG. 6, the coil component 300 may include a body 31, and a first external electrode 321 and a second external electrode 322 disposed on an external surface of the body 31.

The body 31 may have a coil 311 embedded therein, and the coil 311 may include a first lead portion 311*a*, connected to the first external electrode 321, and a second lead portion 311*b*, connected to the second external electrode 322. The coil 311 may include an upper coil 3111 and a lower coil 3112, but the present disclosure is not limited thereto.

As illustrated in FIG. 6, a coil region of the upper coil 3111, excluding the first lead portion 311*a*, may be a coil body 3111*c*, and a coil region of the lower coil 3112, excluding the second lead portion 311*b*, may be a coil body 3112*c*.

Further, a support member may be disposed on a lower surface of the upper coil 3111 and an upper surface of the lower coil 3112, and an outer boundary surface of the support member may be spaced apart from an internal surface of the first external electrode 321 and/or an internal surface of the second external electrode 322, at a predetermined interval E. In more detail, the outer boundary surface of the support member may be spaced apart from a junction portion in which the first external electrode 321 may be connected to the first lead portion 311*a*, and/or spaced apart from a junction portion in which the second external electrode 322 may be connected to the second lead portion 311*b*. This means that a portion of the support member has been removed, unlike the initial support member, which extended to the junction portion.

Thus a region E, from which the portion of the support member has been removed, may be filled with a magnetic material, and a margin portion may be secured, to increase permeability of the coil component 300.

FIG. 6 illustrates the outer boundary surface of the support member as protruding in the length direction L of the body 31, in which the first or second lead portion 311*a* or 311*b* is disposed, in the same shape as that of the coil body 3111*c* or 3112*c*. A person skilled in the art may appropriately select a degree of the protrusion. However, the present disclosure is not limited to the degree of the protrusion illustrated in FIG. 6. It may be sufficient that the outer boundary surface of the support member may be spaced apart from the junction portion, in which the coil 311 and the first or second external electrode 321 or 322 may be connected to each other, at a predetermined interval.

Figure 7:
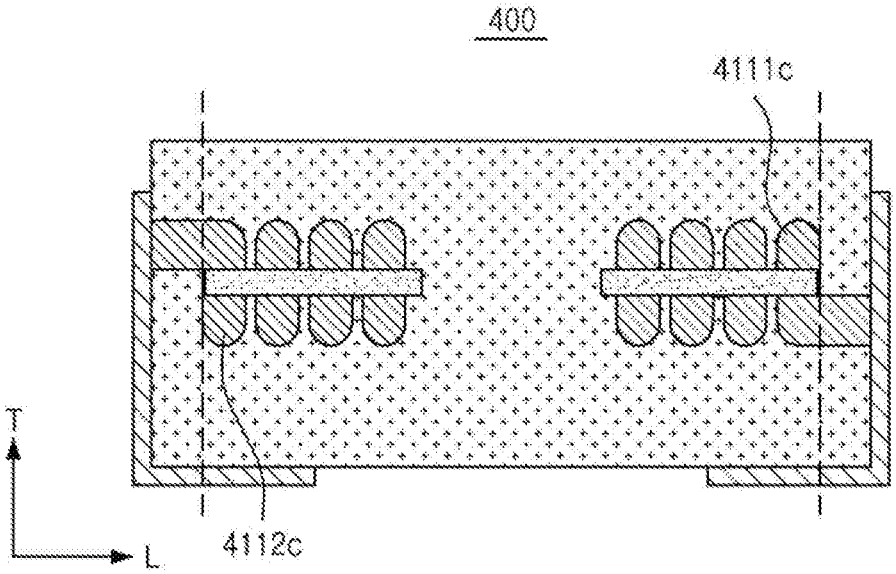
FIG. 7 is a schematic cross-sectional view of a modification of FIG. 6.

FIG. 7 is a modification of the outer boundary surface of the support member illustrated in FIG. 6. In a coil component 400 of FIG. 7, an exterior of a support member may be substantially co-planar with an exterior of the coil body such that an outer boundary surface of the support member is coplanar with an outermost coil the coil body. The coil component 400 may have a predetermined width in a direction in which a first or second lead portion are disposed and extended from the coil body, and the support member may have no protruding portion from the coils. This means that, since the coil component 400 of FIG. 7 is filled with a larger amount of magnetic material, compared to the coil component 300 of FIG. 6, given the same coil component size, a level of inductance may be increased.

As illustrated in FIG. 7, an outer boundary surface of the support member may be structurally coplanar with that of an outermost coil pattern of a coil body 4111*c* or 4112*c*.

Figure 8:
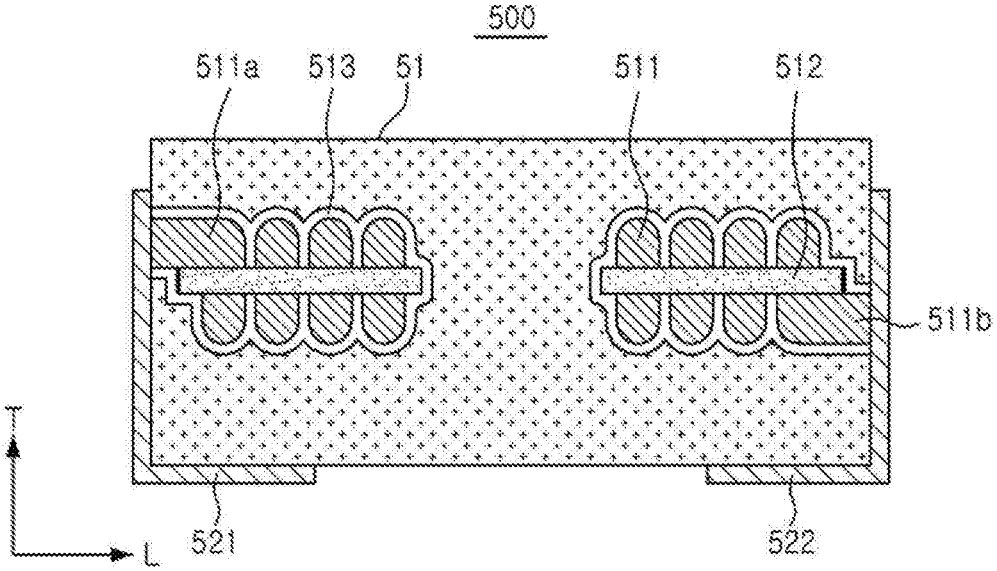
FIG. 8 is a schematic cross-sectional view of another modification of FIG. 6.

FIG. 8 is a schematic cross-sectional view of a coil component 500 according to a modification of FIG. 6. FIG. 8 may differ from FIG. 6 in that an insulating layer 513 may be additionally disposed on an external surface of a coil 511 and an exposed surface of a support member 512.

Referring to FIG. 8, the coil component 500 may include a body 51 including the coil 511 and a support member 512, and a first external electrode 521 and a second external electrode 522. The coil component 500 may further include the insulating layer 513 disposed consecutively on the external surface of the coil 511 and on the exposed surface of the support member 512.

The insulating layer 513 may be disposed on a lower surface of a first lead portion 511*a* of the coil 511 and an upper surface of a second lead portion 511*b* of the coil 511, of the external surface of the coil 511. Since lower surfaces of lead portions of a coil in a thin film inductor according to the related art are in contact with a substrate supporting the lead portions, there is no need or room to include an additional coated insulating layer. However, in the case of the coil component according to this embodiment, the portion of the support member adjacent to the junction portion, in which the external electrode may be connected to the lead portion of the coil, on the outer boundary surface of the support member, may be removed. Thus, the insulating layer may be additionally disposed on the remainder of the support member and on the lead portion of the coil not supported by the remainder of the support member.

As set forth above, according to the embodiments, a level of inductance of a coil component may be increased by removing unnecessary insulating material and filling the resulting margin portion with a magnetic material. Further, the bonding force of an external electrode, which is generally poor in bonding force with respect to the insulating material, in the coil component may be remarkably increased by removing the unnecessary insulating material.

While exemplary embodiments have been shown and described above, it will be apparent to those skilled in the art that modifications and variations could be made without departing from the scope of the present invention, as defined by the appended claims.

What is claimed is:

1. A coil component comprising:

a body;

a support substrate embedded in the body;

a coil including a plurality of coplanar coil turns embedded in the body and including a lower surface having a first portion disposed on the support substrate; and an insulating layer disposed on upper surfaces of the coil turns, wherein at least a second portion of the lower surface of the coil, laterally adjacent to an end surface of the support substrate, directly contacts the insulating layer.

2. The coil component of claim 1, wherein the coil includes a coil lead portion extending from the coil turns to a side surface of the body, and the coil lead portion includes the second portion of the lower surface of the coil and directly contacts the insulating layer on upper and lower surfaces thereof.

3. The coil component of claim 2, wherein the support substrate is spaced apart from and does not contact the side surface of the body to which the coil lead portion extends.

4. The coil component of claim 2, wherein the plurality of coplanar coil turns includes a plurality of first coplanar coil turns disposed on an upper surface of the support substrate and including the first portion of the lower surface disposed on the support substrate, and the coil further includes a plurality of second coplanar coil turns disposed on a lower surface of the support substrate and having the insulating layer disposed on lower surfaces thereof, and a second coil lead portion extends from the second coplanar coil turns to another side surface of the body, and the second coil lead portion directly contacts the insulating layer on upper and lower surfaces thereof.

5. The coil component of claim 2, wherein the support substrate has a side surface facing the side surface of the body to which the coil lead portion extends, and the side surface of the support substrate is spaced apart from and does not contact the side surface of the body.

6. The coil component of claim 1, wherein the second portion of the lower surface of the coil that directly contacts the insulating layer is coplanar with the first portion of the lower surface of the coil disposed on the support substrate.

7. The coil component of claim 1, wherein the insulating layer is disposed between adjacent coil turns of the coil.

8. The coil component of claim 1, wherein the first portion of the lower surface of the coil that is disposed on the support substrate is free of the insulating layer.

9. The coil component of claim 1, wherein the coplanar coil turns include the first portion of the lower surface of the coil and are in direct contact with the support substrate.

10. A coil component comprising:

a body;

a support substrate disposed in the body;

a coil disposed on at least one surface of the support substrate and having a lower surface of which at least a portion is in contact with the support substrate;

an insulating layer disposed on the coil; and an external electrode disposed on the body and connected to the coil, wherein the support substrate is spaced apart from the external electrode, and the insulating layer is in contact with at least a portion of a region of the lower surface of the coil laterally adjacent to, and not contacting, the support substrate.

11. The coil component of claim 10, wherein the coil includes a first lead portion exposed from a first surface of the body, and wherein the insulating layer is in contact with at least a portion of a lower surface of the first lead portion.

12. The coil component of claim 11, wherein the body includes a magnetic material, and wherein the insulating layer is disposed between the magnetic material and the at least a portion of the lower surface of the first lead portion.

13. The coil component of claim 11, wherein the support substrate has one side surface facing the external electrode and spaced apart from the external electrode, and wherein the insulating layer covers the one side surface of the support substrate.

14. The coil component of claim 13, wherein the body further includes a second surface opposing the first surface, and a third surface connecting the first and second surfaces, the coil further includes a first coil pattern having at least a portion of a lower surface in contact with the one surface of the support substrate, and a second coil pattern having at least a portion of an upper surface in contact with another surface of the support substrate opposing the one surface of the support substrate, the insulating layer is disposed on each of the first and second coil patterns, the first lead portion extends from the first coil pattern, and a second lead portion extends from the second coil pattern and is exposed from the second surface of the body, the external electrode includes a first external electrode disposed on the first surface of the body and connected to the first lead portion, and a second external electrode disposed on the second surface of the body and connected to the second lead portion, the one side surface of the support substrate faces the first surface of the body, and another side surface of the support substrate faces the second surface of the body, and the insulating layer is in contact with at least a portion of a lower surface of the first lead portion, at least a portion of an upper surface of the second lead portion, the one side surface of the support substrate, and the another side surface of the support substrate.

15. The coil component of claim 14, wherein a through-hole extends through a central portion of the support substrate, wherein a portion of the body is disposed in the through-hole of the support substrate, and the insulating layer is continuously disposed on the first coil pattern, an inner wall of the through-hole, and the second coil pattern.

16. The coil component of claim 13, wherein the insulating layer covers an entire side periphery of the support substrate including the one side surface of the support substrate.

17. The coil component of claim 13, wherein the insulating layer continuously extends from the at least a portion of the lower surface of the lead portion to the one side surface of the support substrate.

18. The coil component of claim 11, wherein the insulating layer is exposed from the surface of the body at a position directly adjacent to an exposed surface of the lead portion.

19. The coil component of claim 18, wherein an exposed surface of the insulating layer, exposed from the surface of the body, extends around an entire periphery of the exposed surface of the lead portion.

20. The coil component of claim 11, wherein the support substrate is not exposed from the body.

* * * * *